US005707272A

United States Patent [19]

Hashimoto et al.

[11] Patent Number: 5,707,272

[45] Date of Patent: Jan. 13, 1998

[54] POLISHING APPARATUS FOR A CRT GLASS PANEL AND A METHOD OF POLISHING THE GLASS PANEL

[75] Inventors: Takeshi Hashimoto, Funabashi; Masatsugu Yamanaka, deceased, late of Yokohama, by Fujiko Yamanaka, legal representative; Hiroyuki Ugajin; Tomoya Takigawa, both of Funabashi, all of Japan

[73] Assignee: Asahi Glass Company Ltd., Tokyo, Japan

[21] Appl. No.: 701,015

[22] Filed: Aug. 21, 1996

[30] Foreign Application Priority Data

Nov. 8, 1995 [JP] Japan ..... 7-289813
Jan. 12, 1996 [JP] Japan ..... 8-003663

[51] Int. Cl.[6] ..... B24B 1/00

[52] U.S. Cl. ..... 451/41; 451/65; 451/121; 451/254; 451/123

[58] Field of Search ..... 451/41, 42, 63, 451/242, 246, 254, 255, 236, 59, 121, 123, 109, 285–289

[56] References Cited

U.S. PATENT DOCUMENTS 2,821,813 2/1958 Degler ..... 451/289
2,966,010 12/1960 Guigard ..... 451/123
3,032,931 5/1962 Eversole ..... 451/121
3,943,666 3/1976 Dion et al. ..... 451/254

FOREIGN PATENT DOCUMENTS 401295753 11/1989 Japan ..... 451/63

*Primary Examiner*—Robert A. Rose
*Assistant Examiner*—George Nguyen
*Attorney, Agent, or Firm*—Oblon, Spivak, McClelland, Maier & Neustadt, P.C.

[57] ABSTRACT

When a face portion of a CRT glass panel is polished by fixing the glass panel on a rotating table and pushing a rotating cylindrical drum type polishing tool, which is supported by a supporting frame, to the face portion, the supporting frame is swung around a pivotal point so as to swing the polishing tool along an arc line on the face portion of the glass panel, and the polishing tool is moved reciprocately in a horizontal direction in association with an angle of rotation of the glass panel. Therefore, the face portion is polished while the distance between the rotation axis of the polishing tool and the center of the glass panel is changed. Since deflection of wearing of the polishing tool is decreased, the service life is prolonged, and further efficiency of polishing is improved.

10 Claims, 6 Drawing Sheets

POLISHING APPARATUS FOR A CRT GLASS PANEL AND A METHOD OF POLISHING THE GLASS PANEL

BACKGROUND OF THE INVENTION

1. Field of the Invention

The present invention relates to a polishing apparatus for a CRT glass panel and a method of polishing the same.

2. Discussion of Background

Heretofore, a glass panel which constitutes a picture image displaying portion of a cathode ray tube (CRT) for television or a display has been formed by charging a mass of glass molten (gob) at about 1,000° C. into a metal mold and pressing the gob. In such press-forming method, however, a spot defect such as a minute sharp recess or a line defect in a wrinkle form is apt to take place in a face portion of the glass panel which is used as a screen or a picture image displaying portion. In order to eliminate such a defect so as to obtain a product of a good quality in optical sense, a polishing treatment has been conducted to the face portion of the glass panel. Here, the polishing treatment includes grinding as well as polishing, and indicates at least one of them.

As methods of polishing the face portion of a glass panel, there has been known such a method that a cylindrical sleeve made of rubber or felt is rotated around the center axis of the cylindrical sleeve, and the rotating sleeve is pushed to the face portion (hereinbelow, referred to as a drum polishing method). In the drum polishing method, the cylindrical sleeve having flexibility is rotated and pushed to the face portion of the glass panel having predetermined radius of curvatures while an appropriate inner pressure is applied to the inside of the cylindrical sleeve, and polishing is conducted in the presence of an abrasive material in a state of slurry, which has appropriate hardness and a grain size. Accordingly, the cylindrical sleeve can follow up a shape of the face portion, and the drum polishing method is suitable as a method of polishing a glass panel having various radius of curvatures.

However, in conventional drum polishing apparatuses, a cylindrical polishing tool is driven by only means which rotates around the center axis of a cylindrical member. In this case, a part of the cylindrical polishing tool, in particular, a portion corresponding to an edge portion of the glass panel was locally worn, which shortened the service life of the polishing tool.

In order to eliminate the above-mentioned disadvantage, Japanese Unexamined Patent Publication No. 31609/1995 proposes a polishing apparatus in which polishing is conducted during the movement of a cylindrical polishing tool in the direction of the rotation axis to thereby reduce local wearing of the cylindrical polishing tool. In this apparatus, however, although there is a certain effect to increase the width of local wearing in a portion corresponding to an edge portion of a glass panel, it is impossible to uniformly wear the entire width of the cylindrical polishing tool so that the entire width can effectively be utilized. Thus, the effect of extending the service life of the cylindrical polishing tool is insufficient.

Further, in the conventional drum polishing method, polishing is carried out by setting the distance between the center of rotation of the glass panel and the rotation axis of the cylindrical polishing tool (hereinbelow, referred to as "drum offset") to have a fixed value. Accordingly, there is a large difference in quantity of polishing in the face portion of the glass panel, and it is difficult to uniformly polish the entire face portion with use of a single polishing apparatus. In order to polish uniformly the face portion, it is necessary to use a plurality of drum polishing apparatuses in combination of several kinds of "drum offset". Thus, there are needed a number of polishing apparatuses.

Further, it is necessary to determine a large drum offset in order to polish four corners of the face portion. In this case, however, a portion of the cylindrical polishing tool is beyond the face portion whereby efficiency of polishing is decreased. Such disadvantage is remarkable in a panel wherein the length in the lateral direction is relatively long (having an aspect ratio of 9:16) which has been widely used in recent years.

SUMMARY OF THE INVENTION

It is an object of the present invention to provide a method of polishing a CRT glass panel and an apparatus for carrying out the method wherein the service life of a cylindrical polishing tool can be prolonged by effectively utilizing the entire portion of the polishing tool and efficiency of polishing can be increased.

The above-mentioned object and other objects have been attained by providing a polishing apparatus for a CRT glass panel comprising a rotating table which is rotated at a predetermined speed and is adapted to fixedly mount a glass panel on it, and a cylindrical drum type polishing tool which is pushed with a predetermined force and a predetermined inner pressure to the glass panel so as to polish the same, wherein the cylindrical drum type polishing tool is rotated around its center axis as the rotation axis and is swung around a point, as the center of rotation, on an arbitrary linear line which is perpendicular to the rotation axis, whereby the rotation axis of the polishing tool undergoes a reciprocating movement on an arc line around the center of rotation, during the polishing of the glass panel.

In order to achieve the above-mentioned objects in a further effective manner, the polishing tool is swung around a point on a linear line which is perpendicular to the rotation axis of the polishing tool so that the rotation axis of the polishing tool undergoes a reciprocating movement on an arc line, and the polishing tool is moved reciprocately so that the distance between the center of the glass panel and the center axis of the polishing tool is changed.

In accordance with the present invention, there is provided a method of polishing a CRT glass panel comprising mounting fixedly a CRT glass panel with a face portion to be polished directing upwardly on a rotating table; rotating a cylindrical drum type polishing tool around its center axis, and pushing the polishing tool to the face portion to polish it, wherein the glass panel is mounted fixedly on the rotating table so as to agree the center of the glass panel with the rotation center of the rotating table, and the distance between the center of the glass panel and the center axis of the polishing tool is changed depending on an angle of rotation of the glass panel.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
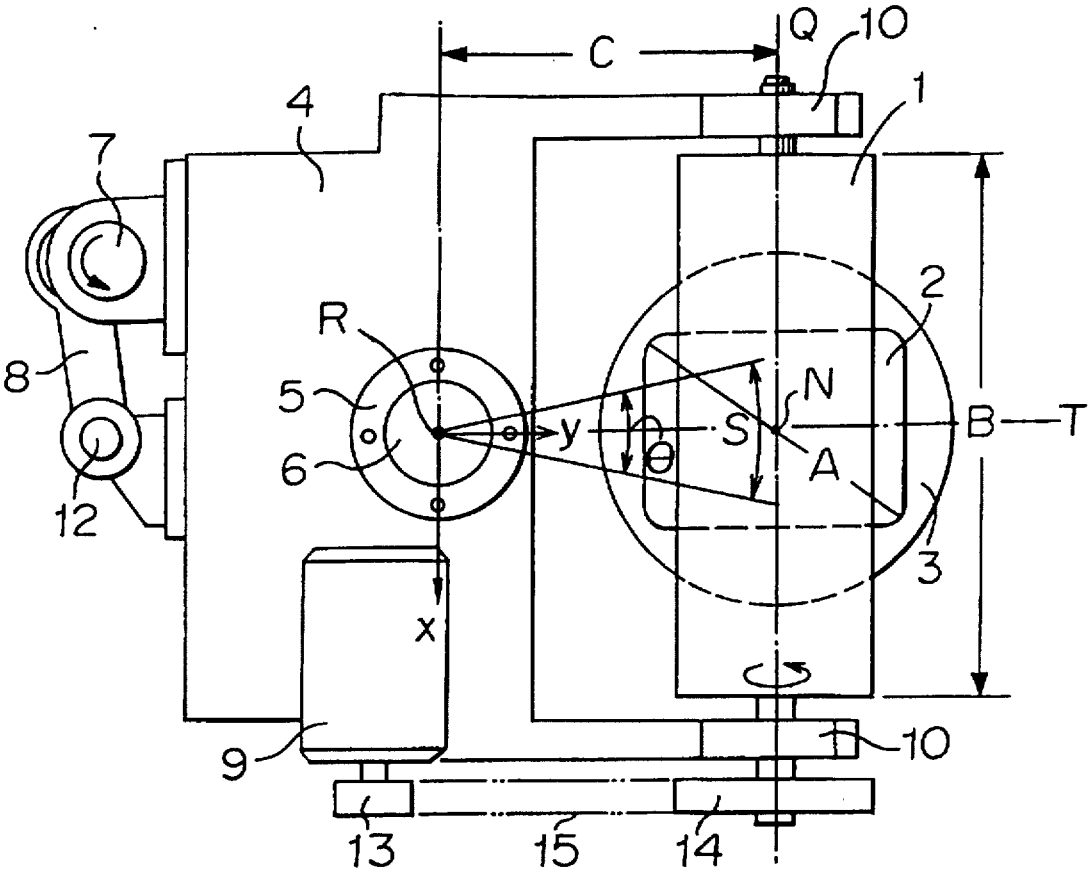
FIG. 1 is a plane view of an embodiment of the drum type polishing apparatus according to the present invention.
Figure 2:
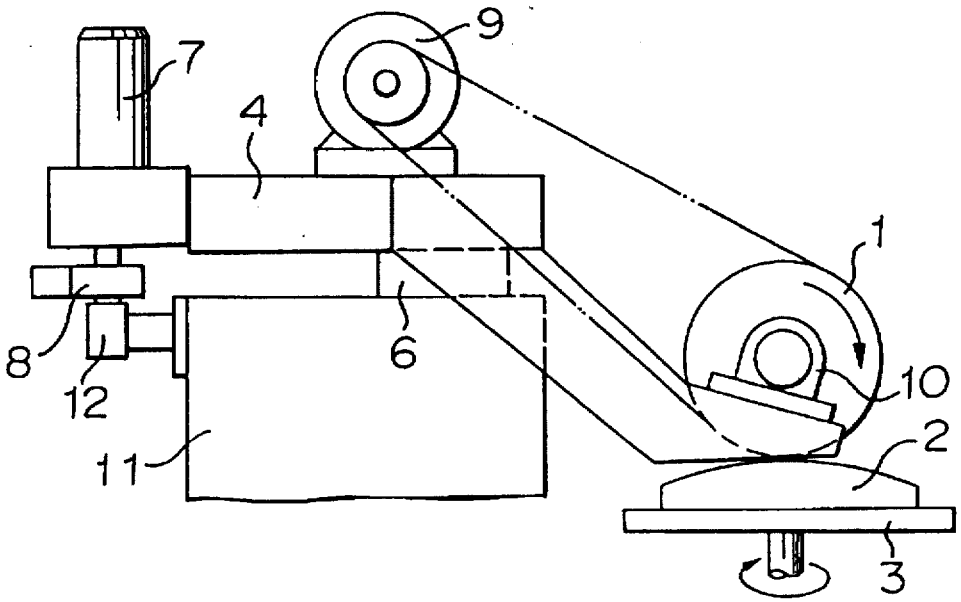
FIG. 2 is a side view partly omitted of the drum type polishing apparatus in FIG. 1.

Preferred embodiments of the present invention will be described in more detail with reference to the drawings wherein the same reference numerals designate the same or corresponding parts. FIGS. 1 and 2 show an embodiment of the drum type polishing apparatus of the present invention. The polishing apparatus has a rotating table 3 which is adapted to mount fixedly a glass panel 2 and is rotated at a predetermined number of revolution, which is preferably in a range of 5 to 100 rpm, more preferably, in a range of 10 to 50 rpm. When it is less than 5 rpm, efficiency of polishing is decreased. On the other hand, when it exceeds 100 rpm, the fixing of the glass panel becomes difficult, and a motor having a large capacity is needed.

A cylindrical drum-type polishing tool 1 (hereinbelow, referred to as a polishing tool) is disposed above the rotating table 3. The polishing tool 1 is rotated around the center axis of the cylindrical member, as the rotation axis, and is pushed to a face portion of the glass panel 2. The polishing tool 1 has both ends at the rotation axis which are supported in a rotatable manner by a pair of bearings 10 fixed to a supporting frame 4. A pulley 14 is fixed to an end of the rotation axis, and the pulley is connected to a pulley 13 of a motor 9 disposed on the supporting frame 4 by means of a belt 15. Thus, the polishing tool is rotated by the motor 9.

The diameter of the polishing tool 1 is preferably in a range of 300 to 800 mm. When it is less than 300 mm, it is difficult to increase circumferential speed of the polishing tool. On the other hand, when it exceeds 800 mm, the strength of the polishing tool against the inner pressure is decreased. It is necessary to determine the length of the polishing tool in the axial direction depending on a size of glass panel in order to obtain a good follow-up characteristic to the face portion when the polishing tool is pushed to the glass panel. In this respect, the relation between the length of diagonal line A of the glass panel and the length of the polishing tool B is preferably $1.5A<B<2.5A$. A value less than 1.5A provides an insufficient follow-up characteristic to the face portion, and a value of more than 2.5A results a large deformation of the polishing tool when it is pushed to the glass panel. The deformation will cause vibrations due to the rotation of the polishing tool thereby decreasing efficiency of polishing.

The number of revolution of the polishing tool 1 should be in a range of 100 to 1,000 rpm, more preferably, 300 to 800 rpm. A value of less than 100 rpm will decrease the circumferential speed of the polishing tool, and on the other hand, a value of more than 1,000 rpm will result in vibrations.

It is desirable that the polishing tool 1 is of a hollow body and made of rubber or felt so as to obtain a good follow-up characteristic to radius of curvatures of the face portion. The polishing tool 1 is used with the application of a predetermined inner pressure which should be in a range of 0.2 to 2 $kg/cm^2$, more preferably, 0.4 to 1.2 $kg/cm^2$. When the inner pressure is less than 0.2 $kg/cm^2$, a force resulted from the pushing is insufficient and efficiency of polishing is reduced. On the other hand, when it exceeds 2 $kg/cm^2$, the follow-up characteristic to the radius curvatures of the face portion is decreased.

The supporting frame 4 is supported by a rotating shaft 6 extending from a polishing machine base 11 through a bearing 5 so as to be swung. When the supporting frame 4 is swung around the rotating shaft 6 as the center of rotation R, the polishing tool 1 performs a reciprocating movement on an arc line as indicated by an arrow mark S above an upper surface of the rotating table 3. In this case, the rotating shaft 6 is usually disposed on an arbitrary linear line which crosses at a right angle to the rotation axis of the polishing tool 1. The polishing tool 1 and the rotating table 3 should be disposed in such a relation that the center line in an angle of swinging of the polishing tool 1 passes through the center of rotation of the rotating table 3 whereby the polishing tool 1 uniformly acts on the glass panel 2 fixed on the rotating table 3. The distance C between the center of rotation R and the center axis Q of the polishing tool 1 should be an appropriate distance depending on the size of the glass panel 2 to be polished and the length B in the axial direction of the polishing tool 1, and is preferably in a range of $0.5B<C<1.5B$. A suitable angle of rotation in an arcuate movement of the polishing tool is 2° to 30°. The quantity of movement of the polishing tool varies depending on θ. A component D in an X direction of the movement of the polishing tool is expressed by $D=2\cdot C\cdot\tan(\theta/2)$, and a range of $40\text{ mm}\leqq D\leqq B-A$ is preferable. When D is less than 40 mm, the prolongation of the service life of the polishing tool is small. On the other hand, when D is greater than B−A, the polishing tool largely extends beyond the edge of the glass panel whereby efficiency of polishing is decreased. In this description, a component of an X direction represents a direction perpendicular to a line connecting the center of rotation R for an arcuate movement of the polishing tool to the center N of the rotating table as shown in FIG. 1.

A motor 7 with a reduction unit is fixed to a portion (at the left end side in FIG. 1) of the supporting frame 4. An eccentric plate is fixed to the output shaft of the motor, and the eccentric plate is rotatable in a cam opening formed at an end of an arm 8. The other end of the arm 8 is connected to the machine base 11 by means of a pin 12. Accordingly, when the motor 7 is actuated, the supporting frame is swung around the rotating shaft 6 due to the associated function of a rotating motion of the eccentric plate and a pendulum motion of the arm 8 whereby the polishing tool 1 is swung along the before-mentioned arc line. The period of the swinging motion of the polishing tool 1 depends on the number of revolution of the motor. Since the supporting frame 4 and the polishing tool 1 respectively have a large inertia, it is difficult to move them at a fairy high speed from the viewpoint of manufacturing. Accordingly, the period is preferably in a range of 1 to 50 cycles/min. The magnitude of the swing motion of the polishing tool 1 can be adjusted by a degree of eccentricity of the eccentric plate. The mechanism of swing can be obtained by using an air-actuated cylinder or an oil-actuated cylinder other than the structure using the eccentric plate and the motor 7.

With respect to use of an abrasive material, there is a polishing method wherein slurry including abrasive grain is applied to the contacting portion between the polishing tool and the face portion of a glass panel, or a polishing method wherein the polishing tool including abrasive grain, either of which may be used in the present invention.

When the polishing tool 1 is swung on the arc line, the polishing tool 1 follows a synthesized motion of the movement in the direction of the rotation axis of the polishing tool (movement in an x direction) and the movement of the direction perpendicular thereto (movement in a y direction). Such movement of the polishing tool 1 improves the follow-up characteristics to the radius of curvatures of the face portion of the glass panel in comparison with the polishing apparatus wherein the polishing tool is slided in the direction of the rotation axis (movement of an x direction only) as described in Japanese Unexamined Patent Publication No. 31609/1994, and the entire portion of the polishing tool is uniformly worn. Thus, the service life of the polishing tool 1 can remarkably be extended, and the face portion of the glass panel can further be uniformly polished. Although the reason why the follow-up characteristics of the polishing tool to the face portion is improved by the associated movement of x and y directions of the polishing tool in comparison with a merely reciprocating movement in only an x direction is not sufficiently clarified, it is considered that deformation in the polishing tool rotating around its rotation axis during a reciprocating movement varies depending on directions of movement.

Figure 3:
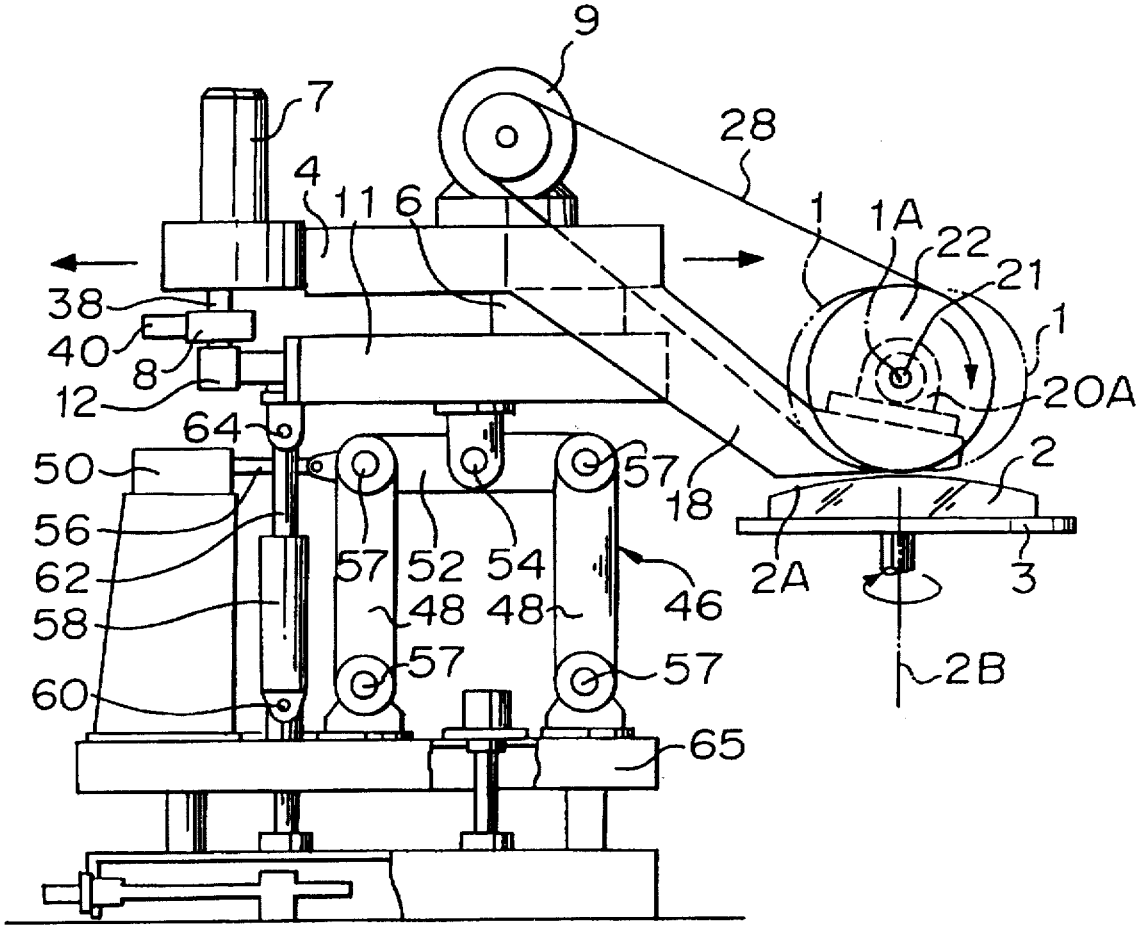
FIG. 3 is a side view of another embodiment of the drum type polishing apparatus according to the present invention.

FIG. 3 shows another embodiment of the polishing apparatus of the present invention. In this embodiment, means for changing the distance between the center 2B of the CRT glass panel and the center axis 1A of the polishing tool 1 (hereinbelow, referred to as "an offset mechanism") is attached to the polishing apparatus shown in FIGS. 1 and 2. Since the mechanism for swinging the polishing tool 1 around the rotating shaft 6 is substantially the same as the above-mentioned embodiment, description is omitted.

The offset mechanism 46 comprises a parallel crank means provided with a pair of arms 48, 48 and an oil-actuated cylinder 50 for actuating the parallel crank means. The parallel crank means is to cause a reciprocating movement of the base 11 in parallel to a ground table 65 with respect to the glass panel 2. The base 11 is supported by a horizontal arm 52, by means of a pin 54, which is connected between the pair of arms 48, 48. The oil-actuated cylinder 50 has a rod 56 whose free end is connected to a left end portion of the horizontal arm 52. When the rod 56 of the oil-actuated cylinder 50 is expanded or contracted, the parallel crank means is actuated by four links in which each connecting portion is provided with a pin 57. Thus, the parallel movement of the base 11 is caused in the front and back directions with respect to the glass panel 2 fixedly mounted on the rotating table 3. The parallel movement of the base 11 causes the same parallel movement of the supporting frame 4 whereby the distance between the central axis 2B of the glass panel 2 and the center axis 1A of the polishing tool 1 can be changed (offset).

Further, the offset mechanism 46 has a telescopic cylinder 58. The telescopic cylinder 58 is mounted on the ground table 65 by means of a pin 60 so as to be freely swung. The telescopic cylinder 58 has a rod 62 which is connected to the base 11 by means of a pivotal pin 64 so that the telescopic cylinder 58 is inclined with respect to the ground table 65. When the base 11 is moved in parallel to the ground table 65, the telescopic cylinder 58 is swung in accordance with the movement of the base 11, during which the rod 62 is expanded and contracted. Thus, the parallel movement of the base 11 can be smoothly carried out. The offset mechanism 46 can be driven by a combination of an eccentric plate and an electric motor other than the above-mentioned oil-actuated cylinder 50. The offset movement of the polishing tool 1 may be associated with an angle of rotation of the table or may be independently.

Figure 4:
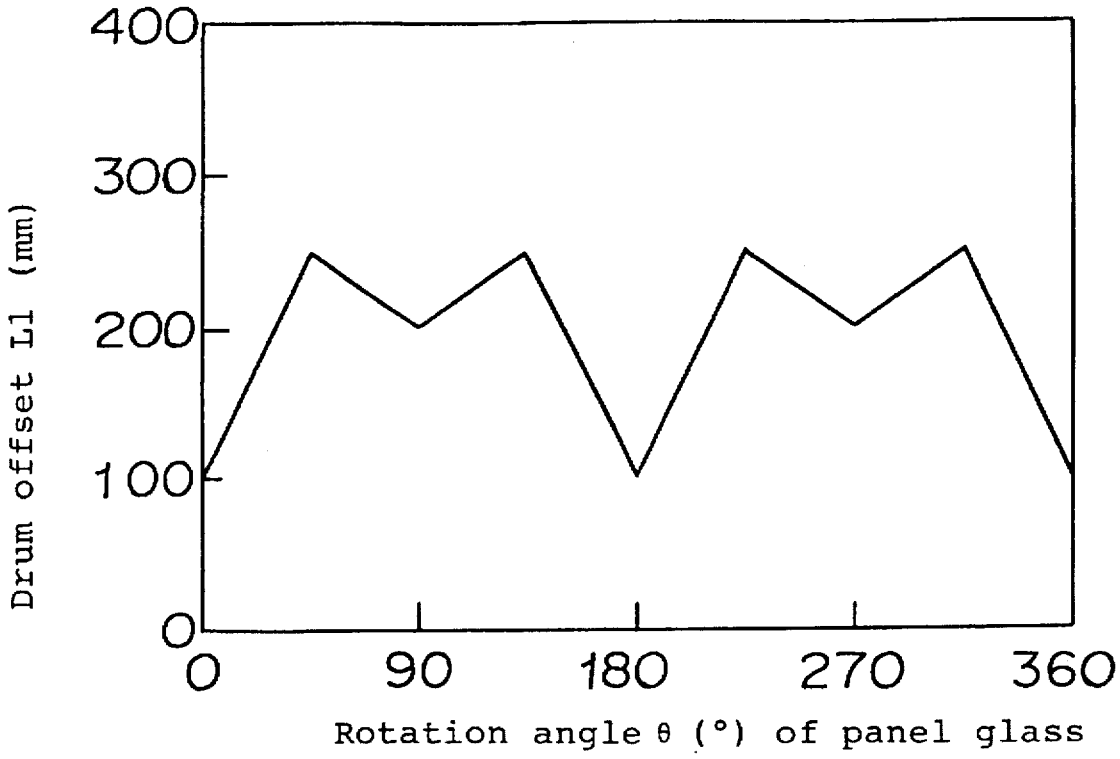
FIG. 4 is a graph showing a relation of an angle of rotation of a CRT glass panel to a drum offset.
Figure 5:
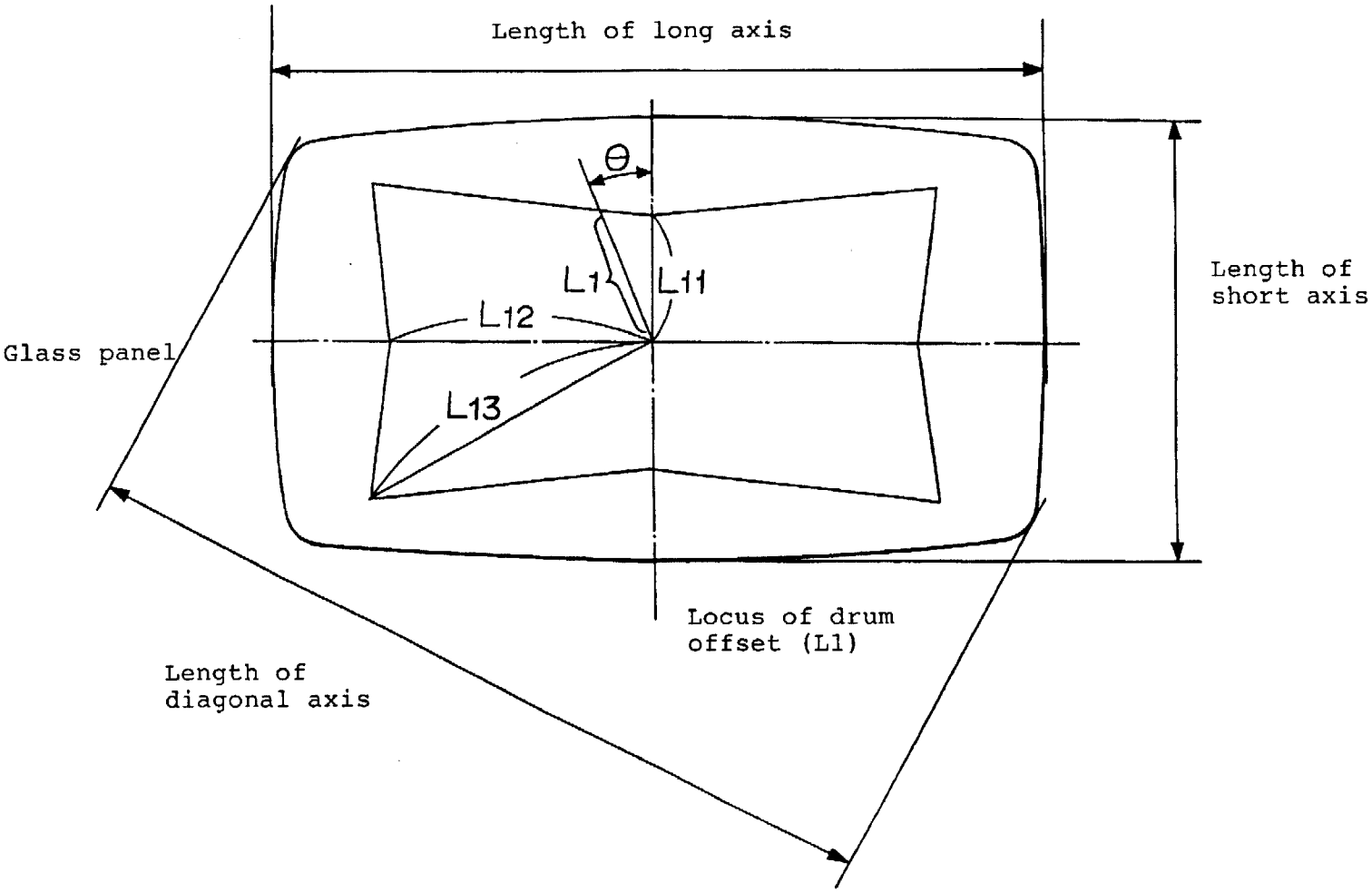
FIG. 5 is a plan view of a CRT glass panel explaining the locus of drum offset.

FIG. 4, as an example of a case that the offset movement is associated with an angle of rotation of the rotating table, is a graph showing a relation of an angle of rotation of the glass panel 2 to a drum offset of the polishing tool (i.e. the distance L1 between the center of the glass panel and the center axis of the polishing tool). FIG. 5 shows an example of the locus of a drum offset (L1) with respect to the center of the face portion of the glass panel 2 wherein the locus corresponds to the graph of FIG. 4 wherein L11 represents that L1 substantially coincides with a short axis, L12 represents that L1 substantially coincides with a long axis and L13 represents that L1 substantially coincides with a diagonal axis. There is a relation of L13>L12>L11.

An angle of rotation θ of the glass panel 2 represents an angle formed between a line L1 and the short axis of the glass panel 2. When θ substantially coincides with an angle formed by a diagonal axis, namely, θ is substantially equal to 60°, 120°, 240° or 110° in a glass panel wherein the length in the lateral direction is relatively larger than the length of the vertical direction (e.g. an aspect ratio of 9:16), or θ is substantially equal to 53°, 127°, 233° or 117° in an ordinary glass panel (an aspect ratio of 3:4), four corners of the face portion 2A can effectively be polished by making the drum offset to be the largest.

When θ equal 0° or 180° the drum offset should be the smallest, and when θ equal 90° or 270°, the drum offset should have an intermediate value whereby reduction of efficiency of polishing due to an extension of the polishing tool 1 from the edge of the face portion 2A is avoidable. When the offset mechanism 46 is used as shown in the above-mentioned embodiment, the entire surface of the face portion of the glass panel 2 can uniformly be polished with a single polishing apparatus.

In the case of carrying out the offset movement independent of the angle of rotation of the rotating table, a reciprocating movement of the polishing tool is in a range of 0 to A/2 in a time period needed for polishing a single glass panel. The frequency N of the offset movement should be in a range of $1/(2t1) \leqq N \leqq F$ where t1 represents a time needed for polishing a single glass panel and F rpm represents the number of revolution of the rotating table. $N=1/(2t1)$ means a movement of once from a greater side to a smaller side of the drum offset (or, vice versa) during the polishing of a single glass panel. Operation in a range of $F \leqq N$ provides a certain effect of reducing the distribution of polishing quantity in the face portion. However, in order to increase N, it is necessary to provide a polishing apparatus having a high rigidity so as to absorb the inertia of movable portions. However, an advantage beyond this can not be expected.

The effect of equalization of the quantity of polishing in the face portion in the case that the offset movement is independent from the angle of rotation of the rotating table, is lower than that of the case that the offset movement is associated with the angle of rotation of the rotating table. However, the former case allows to uniformly polish the entire face portion with a single polishing apparatus, and accordingly, the construction and control of the polishing apparatus can be easy.

In an aspect of the method and the apparatus of the present invention, the polishing can be performed with use of a single polishing apparatus wherein a single locus is used. It is however preferable to polish the glass panel by changing the locus of polishing in order to obtain highly accurate polishing. There are two embodiments for polishing by using different loci.

Figure 6:
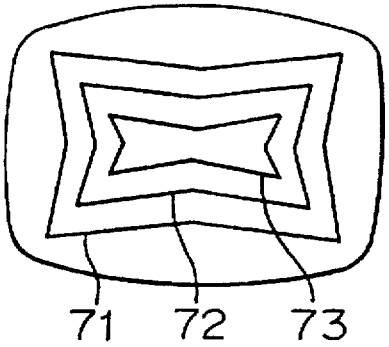
FIGS. 6A and 6B are plan views of CRT glass panels for explaining locus of drum offsets.
Figure 6:
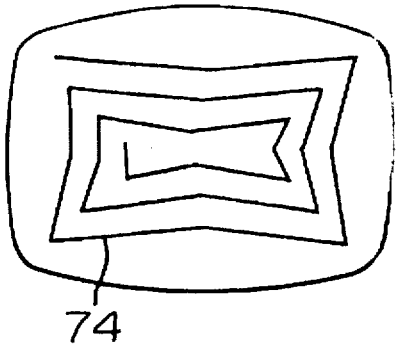

In accordance with the first embodiment, a plurality of drum type polishing apparatuses of the present invention are arranged and different offset values are applied to the plurality of apparatuses. FIG. 6A shows an example of changing the offset value wherein the first apparatus follows a locus 71, the second apparatus follows a locus 72, and the third apparatus follows a locus 73, for instance.

In accordance with the second embodiment, a single polishing apparatus is used wherein the locus of polishing is gradually changed. For instance, the offset value is stepwisely changed as 71→72→73 in the progress of polishing as shown in FIG. 6A whereby the entire surface of the face portion is polished, and then, the offset value is gradually and continuously moved as a locus of 74 as shown in FIG. 6B whereby the entire surface is polished.

In the above-mentioned two embodiments, the quantity of changing the locus may be about 2 to 20 mm in the direction of a diagonal axis. In order to change stepwisely the locus, a change of two steps is generally used. However, it is preferable that a change of 3 to 5 steps be used from the viewpoint of obtaining accurate polishing and productivity. Further, the quantity of changing the locus may be changed, or the above-mentioned two kinds of locus may be combined.

Figure 7:
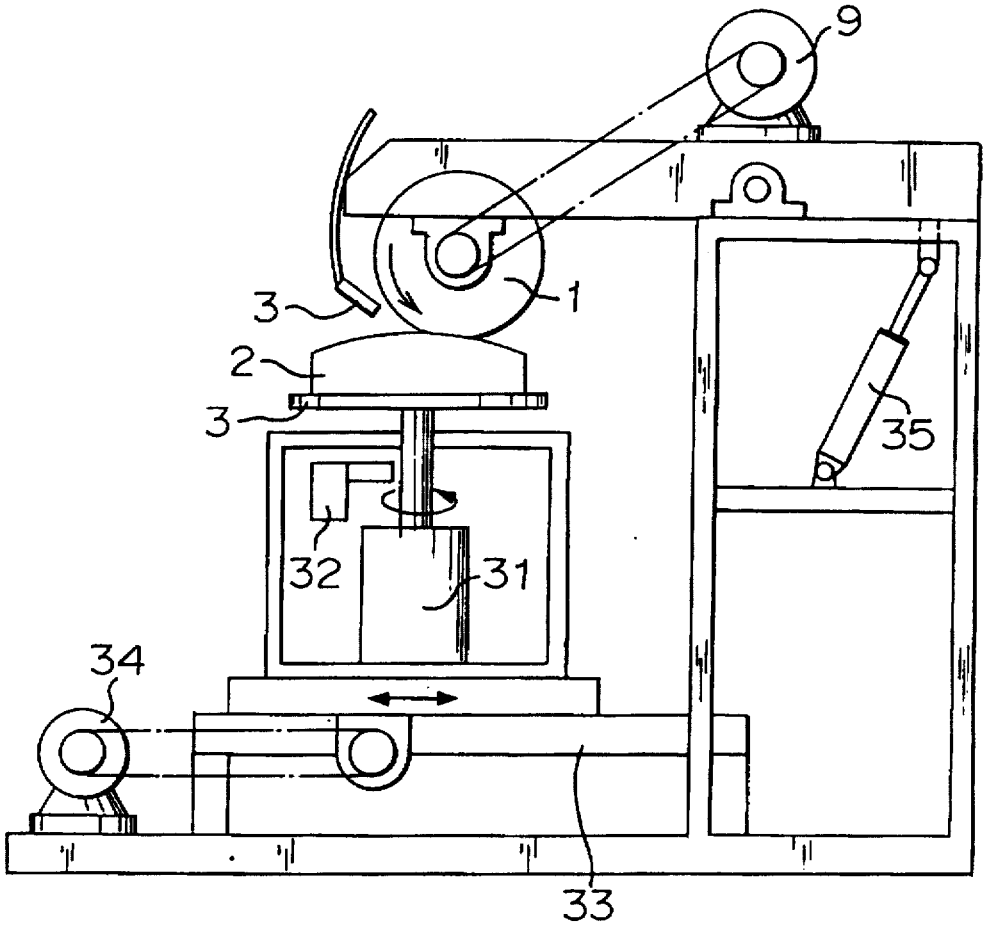
FIG. 7 is a side view of another embodiment of the drum type polishing apparatus according to the present invention.
Figure 8:
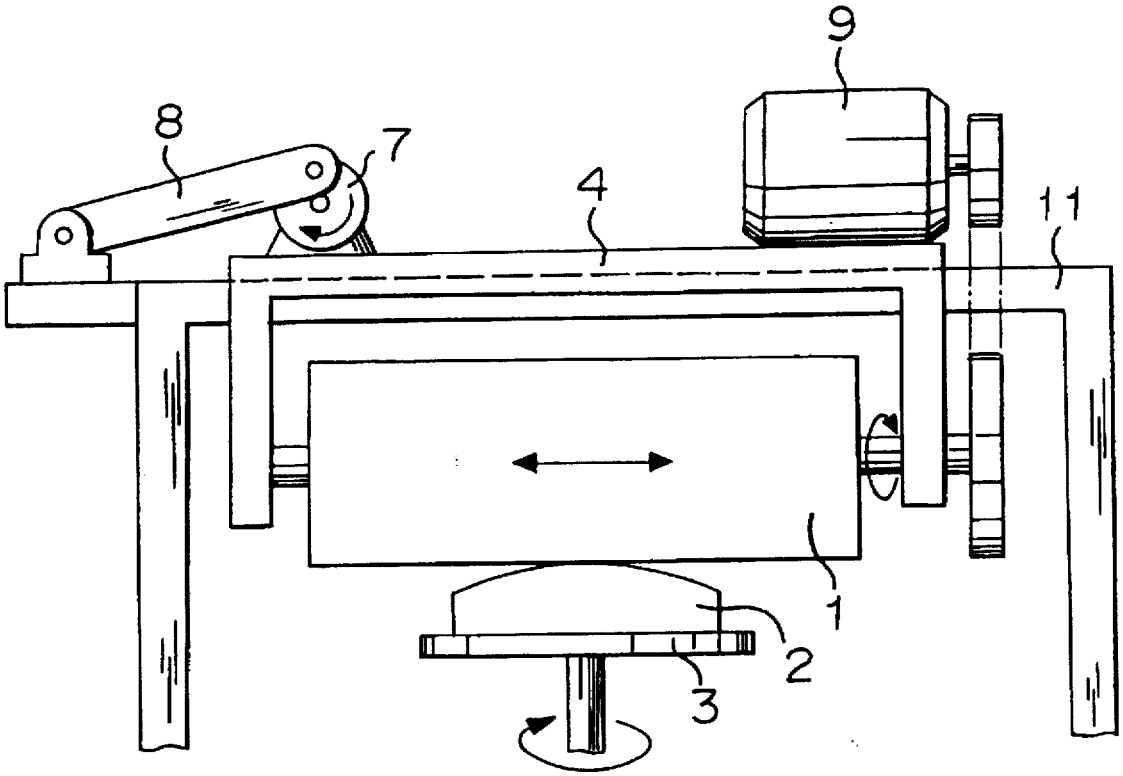
FIG. 8 is a diagram showing a conventional polishing apparatus for a CRT glass panel.

FIG. 7 shows another embodiment of the present invention wherein the glass panel is polished while the offset value is changed in association with an angle of rotation of the glass panel 2. In this embodiment, the polishing tool 1 performs only a reciprocating movement along the face portion of the glass panel 2.

The glass panel 2 is fixedly mounted on the rotating table 3 with its center in agreement with the center of rotation of the rotating table 3. When the glass panel is rotated by means of a motor 31, the polishing tool 1 is pushed to the face portion to polish the same while a slurry of abrasive material is supplied from a nozzle 36. In this case, the polishing tool is rotated by the motor 9 and is vertically moved by means of a cylinder 35.

The rotating table 3 is disposed on a linear slide guide 33 and is capable of a reciprocating movement in an arrow mark direction by means of a servo motor 34. A rotation angle detector 32 is provided on the rotating shaft of the rotating table 3 to detect an angle of rotation of the rotating table 3 or the glass panel 2 whereby the position of the center of rotation of the table 3 is moved with respect to the polishing tool 1 depending on an angle of rotation so that the drum offset is changed. A rotary encoder, a limit switch or the like is usually used for the rotation angle detector 32. A driving source for causing a reciprocating movement of the rotating table may be various kinds of motors, oil-actuated servo cylinders or the like. However, an AC servo motor is particularly preferable in view of easiness of control.

Further, it is possible to fix the position of the center of rotation of the rotating table and to cause a reciprocating movement of the polishing tool.

Conditions of polishing with use of the apparatus of the present invention and control for changing the drum offset of the polishing tool in association with an angle of rotation of the glass panel are substantially the same as those in the embodiment shown in FIG. 3. In this embodiment, effect for wearing uniformly the polishing tool is slightly lower than the case that the swinging movement along an arc line is combined as shown in FIG. 3. However, efficiency of polishing and ability of uniformly polishing the face portion of the glass panel are substantially the same.

Now, the present invention will be described in detail with reference to Examples. However, it should be understood that the present invention is by no means restricted by such specific examples.

EXAMPLE 1

25-inch type glass panels 2 of rectangular shape having an aspect ratio of 3:4 and a diagonal length A of 635 mm were prepared. Each of the glass panels 2 is fixed on a rotating table 3 of a polishing apparatus having the same construction as in FIGS. 1 and 2 so that the center of the glass panel 2 is in agreement with the center of rotation N of the table 3, and the rotating table 3 was rotated at 15 rpm. A drum type polishing tool 1 made of rubber which has a diameter of 500 mm, a length B of 1,300 mm, a thickness of 10 mm and a groove depth in the width direction of 4 mm was attached to a supporting frame 4. The supporting frame 4 and the polishing tool 1 were swung around a rotating shaft 6 at 12 cycles/min. The distance C between the center axis Q of the polishing tool and the center of swinging R of the polishing tool was 800 mm and an angle of rotation θ (an angle for an arcuate motion) of the tool was 8°. An inner pressure of 0.8 $kg/cm^2$ was applied to the polishing tool 1 and the polishing tool was rotated around a center axis Q of cylinder at 500 rpm.

Then, face portions of glass panels were polished by pushing the polishing tool 1 with a pressing force of 500 kg while a pumice slurry of an average diameter of 60 μm is fed. Under the above-mentioned conditions pressing was continued in a pressing time of 30 seconds for each glass panel. In determining the termination of the service life of the polishing tool, the determination was made from the fact that at least a part of the groove formed in the surface of the polishing tool disappeared, i.e. at least a part of the surface of the polishing tool wore by 4 mm. The number of glass panels treated was 28,000. The surface of the polishing tool was worn substantially uniformly over the entire portion which contacted to the glass panels.

COMPARATIVE EXAMPLE 1

A conventional polishing apparatus having a mechanism for causing a reciprocating movement of a polishing tool 1 in the direction of the rotation axis as shown in FIG. 7 was used. The reciprocating movement of the polishing tool was conducted with a period of reciprocating movement of 12 cycles/min and a width of sliding movement of 100 mm.

25-inch type glass panels of substantially rectangular shape having an aspect ratio of 3:4 and a diagonal length of 635 mm were prepared in the same manner as in Example 1. Each of the glass panels 2 was fixed on the rotating table 3 so as to correspond the center of glass panel to the center of rotation of the rotating table 3. Each of the glass panels was polished under the same conditions as Example 1. Namely, the number of rotation of the rotating table, the number of rotation of the polishing tool, the inner pressure to the polishing tool, the pressing force to the polishing tool and the abrasive material are the same.

Polishing was conducted in a polishing time of 30 seconds for each of the glass panels. The number of glass panels treated until a part of the surface of the polishing tool wore by 4 mm was 16,000. It was found that there was a large wearing at a portion corresponding to the panel edge portion.

EXAMPLE 2

28-inch wide type CRT glass panels 2 having an aspect ratio of 9:16 and a diagonal length of 708 mm were polished with a polishing apparatus having the structure as shown in FIG. 3. The same polishing tool 1 and conditions of polishing as in Example 1 were used.

While the rotating table 3 was rotated at 10 rpm, the drum offset L1 was changed in such a manner that when the angle of rotation was 0° or 180°, L11=15 mm (the length of a short axis x 0.29); when the angle of rotation agreed with an angle corresponding to each of four corners, L13=262 mm (the length of a diagonal axis x 0.37), and when the angle of rotation was 90° or 270°, L12=215 mm (the length of the long axis x 0.34).

The face portions 2A of glass panels 2 were polished by pushing from an upper portion the polishing tool 1 with a pressing force of 500 kg while a pumice slurry of an average diameter of 60 μm was fed.

Observation by eyes was conducted every 5 seconds as to the removal of pits of 0.1 mm deep scattering in the entire face portions. As a result, the pits at the central portion of the glass panels 2 were removed in an earlier time, and the pits at four corner portions were removed at last. It took 40 seconds to remove the pits at the central portion of the glass panels, and it took 50 seconds until the pits at four corner portions were removed. Accordingly, a polishing time required was 50 seconds. The total amount of polishing removal was 120 g.

A distribution of polishing area in the face portion was 1.25 wherein "a distribution of polishing area"="a time required for removing pits at four corner portions"/"a time required for removing pits at the central portion".

Polishing was conducted in a polishing time of 30 seconds for each of the glass panels 2. The termination of the service life of the polishing tool was decided from the fact that at least a part of the groove in the surface of the polishing tool disappeared through observation by eyes, i.e., a portion of the surface of the polishing tool 1 wore by 4 mm. The number of glass panels treated until the termination of the service life of the polishing tool was 28,000. The surface of the polishing tool 1 was further uniformly worn in comparison with Example 1, over the entire portion which contacted with the glass panels 2. Further, the polished portion of the glass panels 2 were further uniformly polished in comparison with Example 1.

COMPARATIVE EXAMPLE 2

Glass panels as in Example 2 were polished with use of two polishing apparatus wherein only polishing tools are rotated and two kinds of drum offsets were used to a single glass panel 2. The drum offset for the first polishing apparatus was 100 mm and the drum offset for the second polishing apparatus was 250 mm. Other conditions were same as those in Example 2. Polishing was conducted every 5 seconds by alternately using the two polishing apparatuses, and observation by eyes was conducted as to the removal of pits of 0.1 mm deep scattering in the entire face portion. As a result,it was found that pits at the central portion of the glass panel 2 were removed in the earliest time and pits at four corner portions were removed at last.

It took 20 seconds to remove the pits at the central portion of the glass panel 2 and it took 45 seconds to remove the pits at four corner portions. The time of polishing required was 45 seconds. However, since a single glass panel 2 was polished with two polishing apparatuses, it actually took 90 seconds. It required a longer polishing time than Example 2, and productivity is reduced to ½. The total amount of polishing removal was 180 g. In this comparative example, the wearing of the polishing tools was fairy ununiform in comparison with that in Example 2, and the service life of the polishing tools was shortened.

The apparatus and the method of polishing a CRT glass panel of the present invention can prolong the service life of the polishing tool whereby cost for the polishing tool and a labor cost for exchanging polishing tools can be saved. The polishing apparatus of the present invention improves the follow-up characteristics of the polishing tool to a radius of curvature of the face portion and provides uniform wearing of the polishing tool since the polishing tool is swung in a reciprocating manner in a plane including the rotation axis of it and around a point, as the center of rotation, on a line perpendicular to the rotation axis. Thus, there is no uneven wearing of the polishing tool to thereby prolong the service life.

Further, in the present invention, the face portion of the glass panel is polished by changing the distance between the center of the glass panel and the center axis of the polishing tool in response to an angle of rotation of the glass panel. Accordingly, the entire surface of the face portion can be uniformly polished with a single polishing apparatus.

Obviously, numerous modifications and variations of the present invention are possible in light of the above teachings. It is therefore to be understood that within the scope of the appended claims, the invention may be practiced otherwise than as specifically described herein.

What is claimed is:

1. A polishing apparatus for a CRT glass panel comprising;

a rotating table which is rotated at a predetermined speed and is adapted to fixedly mount a glass panel on the rotating table;

a cylindrical drum type polishing tool which is pushed with a predetermined force and a predetermined inner pressure to the glass panel so as to polish the glass panel;

means for rotating the cylindrical drum type polishing tool around a rotational axis of the cylindrical drum type polishing tool; and means for swinging the cylindrical drum type polishing tool around a point which is on a linear line that is perpendicular to the rotational axis of the cylindrical drum type polishing tool in a direction substantially parallel to an upper surface of the rotating table, during the polishing of the glass panel.

2. The polishing apparatus according to claim 1, wherein a center line in an angle of swinging of the polishing tool passes a center of swinging rotation of the rotating table.

3. The polishing apparatus according to claim 1, wherein the linear line which is perpendicular to the rotational axis of the polishing tool includes a center of swinging rotation around which the polishing tool is swung and passes an intermediate point of a length B in the rotational axis direction of the polishing tool.

4. The polishing apparatus according to claim 1, wherein when a length of a diagonal line of the glass panel is A, a length in an axial direction of the polishing tool is B and a distance between the rotational axis of the polishing tool and a center of swinging rotation of the polishing tool is C, $1.5A<B<2.5A$ and $0.5B<C<1.5B$; an angle of swinging of the polishing tool along an arc line is 2° to 30°, and 40 mm$\leqq 2\cdot C\cdot\tan(\theta/2)\leqq B-A$.

5. The polishing apparatus according to claim 1, wherein said means for swinging comprises means for reciprocating the polishing tool so as to change a distance between a central axis of the glass panel and a rotational axis of the polishing tool.

6. The polishing apparatus according to claim 5, wherein when a length of a diagonal line of the glass panel is A, a length of the polishing tool is B and a distance between the rotational axis of the polishing tool and a center of swinging rotation for swinging movement of the polishing tool along an arc line is C, there are relations of $1.5A<B<2.5A$ and $0.5B<C<1.5B$; an angie of swinging of the polishing tool $\theta$ is 2° to 30°, and 40 mm$\leqq 2\cdot C\cdot\tan(\theta/2)\leqq B-A$.

7. The polishing apparatus according to claim 5, wherein a distance between a center of the glass panel and the rotational axis of the polishing tool is changed within a range of 0 to A/2, when a length of a diagonal line of the glass panel is A.

8. A method of polishing a CRT glass panel, the method comprising the steps of:

fixedly mounting a CRT glass panel on a rotating table;

rotating the rotating table;

pushing a rotating cylindrical drum type polishing tool to a face portion of the glass panel to polish the face portion;

swinging the polishing tool around a point on a linear line which is perpendicular to a rotational axis of the rotating polishing tool; and changing a distance between a central axis of the glass panel and a center axis of the polishing tool.

9. The method according to claim 8, wherein the distance between the central axis of the glass panel and the center axis of the polishing tool is changed depending on an angle of rotation of the glass panel mounted on the rotating table.

10. A method of polishing a CRT glass panel, the method comprising the steps of:

fixedly mounting a CRT glass panel with a face portion to be polished directed upwardly on a rotating table;

rotating a cylindrical drum type polishing tool around a center axis of the polishing tool;

pushing the polishing tool to the face portion to polish the face portion; and changing a distance between a central axis of the glass panel and a rotational center axis of the polishing tool depending on an angle of rotation of the glass, panel;

wherein said step of fixedly mounting the glass panel on the rotating table comprises the step of correlating the central axis of the glass panel with a rotational axis of the rotating table.

* * * * *